US005097770A

United States Patent [19]

Miyashita et al.

[11] Patent Number: 5,097,770

[45] Date of Patent: Mar. 24, 1992

[54] TRAVELING APPARATUS FOR AUTOMATICALLY MOUNTING, DISMOUNTING, AND DRIVING A RAIL CARRIAGE

[75] Inventors: Susumu Miyashita, Kodaira; Nori Harada, Ome, both of Japan

[73] Assignee: Kioritz Corporation, Tokyo, Japan

[21] Appl. No.: 622,131

[22] Filed: Dec. 3, 1990

Related U.S. Application Data

[63] Continuation of Ser. No. 404,390, Sep. 8, 1989, abandoned.

[30] Foreign Application Priority Data

Sep. 19, 1988 [JP] Japan ..... 63-232590

[51] Int. Cl.[5] ..... B61C 11/00

[52] U.S. Cl. ..... 105/72.2; 105/159; 414/537; 180/198

[58] Field of Search ..... 105/722, 215.1, 215.2, 105/100, 159; 104/48, 88, 295, 26.05; 414/537; 180/198

[56] References Cited

U.S. PATENT DOCUMENTS

| | | | |
|---|---|---|---|
| 2,250,070 | 7/1941 | Simmons | 414/537 |
| 2,309,198 | 6/1943 | McCleneghan | 414/537 |
| 2,782,733 | 2/1957 | Ewing | 105/159 X |
| 3,926,128 | 12/1975 | Zappel | 105/26.05 |
| 4,040,761 | 8/1977 | Rahn | 180/198 |
| 4,721,430 | 1/1988 | Littke et al. | 414/537 |

FOREIGN PATENT DOCUMENTS

| | | | |
|---|---|---|---|
| 526017 | 6/1956 | Canada | 105/72.2 |

*Primary Examiner*—Robert J. Oberleitner
*Assistant Examiner*—S. Joseph Morano
*Attorney, Agent, or Firm*—Browdy and Neimark

[57] ABSTRACT

An automatic traveling apparatus comprising a self-propelling car having a self-propelling drive is mounted on a carriage car in such a manner as to be dismountable therefrom. The apparatus also includes a driving-force transmission which, when the self-propelling car is mounted on the carriage car, engages with the self-propelling drive of the self-propelling car to drive the carriage car into traveling.

1 Claim, 3 Drawing Sheets

TRAVELING APPARATUS FOR AUTOMATICALLY MOUNTING, DISMOUNTING, AND DRIVING A RAIL CARRIAGE

This application is a continuation of application Ser. No. 07/404,390, filed Sept. 8, 1989 now abandoned.

BACKGROUND OF THE INVENTION

The present invention relates to an automatic traveling apparatus and, more particularly, to an automatic traveling apparatus in which such operations as the operation of changing the direction of a travel car can be effected automatically and easily using a carriage car.

An electric-motor driven self-propelling car has been employed in various types of work. For instance, the car is employed in sprinkling water or chemicals in a greenhouse where vegetables or the like are cultured, in such a manner that the car travels to and fro on a trough between adjacent ridges formed on the ground within the greenhouse.

The self-propelling car can automatically reciprocate on a trough in a vertical direction, i.e., in the direction in which the trough extends. However, when it is necessary for the car to move transversely, e.g., move to an adjacent trough, an operation is usually conducted in which the car is turned around by man power at one longitudinal end of a ridge.

In order to automatically effect this turning-around operation, Japanese Utility Model Unexamined Publication No. 58-189783 proposes an apparatus provided with, in addition to the self-propelling car, an electric-motor driven self-propelling carriage car which is separate from the self-propelling car and is capable of moving transversely while the self-propelling car is mounted on the carriage car.

The conventional apparatus, however, involves various problems. For instance, two drive devices for the self-propelling car and the carriage car have to be provided separately. Further, during vertical or transverse movement, one of the drive devices which is not in operation stands totally useless. Still further, in order to enable the changing over of the two drive devices, a very complicated structure is required. This renders the entire apparatus large, heavy and expensive. In addition, the apparatus can be transferred and installed only with difficulty, and tends to cause failure.

SUMMARY OF THE INVENTION

The present invention has been made to overcome the problems encountered with the prior art.

An automatic traveling apparatus of the present invention is featured by the provision of a driving-force transmission means which, when the self-propelling car is mounted on the carriage car, engages with a self-propelling drive means of the self-propelling car to drive the carriage car into travelong.

According to the present invention, therefore, without any separate self-propelling drive means being provided on the side of the carriage car, it is possible to utilize the driving force of the self-propelling drive means on the side of the self-propelling car in such a manner as to cause automatic traveling of the carriage car while the self-propelling car is mounted thereon. Thus, by virtue of this utilization of the driving force generated by the drive of the self-propelling car, there is no need to provide any separate drive device for the carriage car. It is therefore possible to simplify the entire mechanism of the apparatus, and to make the apparatus small and light. In this way, the automatic traveling apparatus of the present invention is inexpensive, yet is capable of operating with high reliability, and is suitable for use in various unmanned operations.

PREFERRED EMBODIMENT OF THE PRESENT INVENTION

Figure 1:
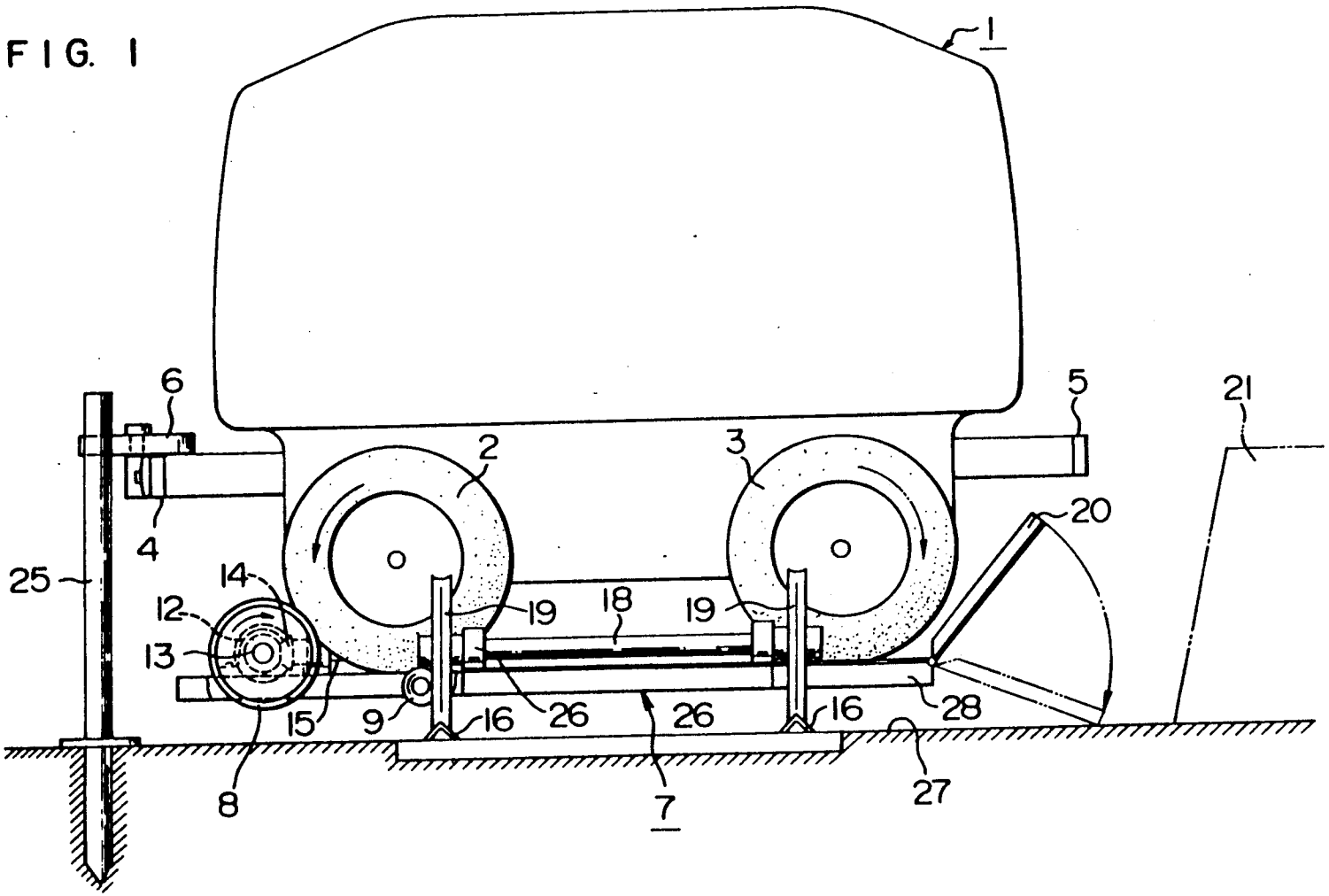
FIG. 1 is a side view of one embodiment of the present invention.

The present invention will be described in detail with respect to one embodiment thereof, shown in the drawings.

The illustrated embodiment is an example of an automatic traveling apparatus of the present invention which has a self-propelling car 1 and a carriage car 7. The self-propelling car 1 is capable of automatically traveling is a reciprocating manner along a trough 23 between adjacent ridges 21 and 22 formed on the ground within a greenhouse where vegetables or the like are cultured. The carriage car 7 is capable of moving in a transverse direction on rails 16 formed with V-shaped steel members and extending in parallel in a headland 27 of the ground at one longitudinal end of the ridges. The carriage car 7 is capable of moving in this manner while the self-propelling car 1 is mounted thereon.

The construction of the self-propelling car 1 will be described hereinafter. Although certain structure of the self-propelling car 1 which is not directly connected to the gist of the present invention is not illustrated, the self-propelling car 1 has a reel with an automatically wound spraying hose, and a spraying nozzle device. The self-propelling car 1 is supported by front wheels 2 and able to automatically travel to and fro. The front and rear wheels 2 and 3 (for convenience, the left side as viewed in FIG. 1 will be called "the front side" of the self-propelling car 1) are respectively disposed on front and rear axles to serve as a self-propelling drive means whose power source is an electric motor whose power is supplied from a battery installed in the self-propelling car 1.

One-way clutches (not shown) may be provided between the electric motor and the rubber-tire type front and rear wheels 2 and 3, the clutch associated with the front wheels 2 and the clutch associated with the rear wheels 3 being capable of rotating opposing directions so as to allow those wheels positioned ahead in the direction in which the self-propelling car 1 advances to always act as the driving wheels. The adoption of this arrangement is preferable because, in this case, it is possible to achieve enhanced traveling performance of the self-propelling car 1 when the self propelling car 1 travels along a trough 23.

Switching rods 4 and 5 for changing the direction of rotation of the electric motor project from the front and rear end of the self-propelling car 1, respectively. Piles 25 are driven into the ground in the headland at either longitudinal end of the ridges. Those piles 25 provided in the railed headland 27 are each positioned further from the ridges 21 and 22 than the rails 16. When the switching rod 4 or 5 abuts against one of the piles, and is thus retracted, the direction of rotation of the electric motor changes, thereby enabling the forward and backward traveling of the self-propelling car 1 to be automatically changed over.

A smoothing roller 6 is provided on the end portion of the front switching rod 4. When the carriage car 7 is advancing transversely on the rails 16 while the self-propelling car 1 is mounted on the carriage car 7, and when the smoothing roller 6 rubs on one of the piles 25, the roller 6 pushes the switching rod 4 (in the direction indicate by the arrow shown on the left side of FIG. 2), whereby the self-propelling car 1 is dismounted from the carriage car 7 and is then positioned in the center of an adjacent trough 23.

Figure 2:
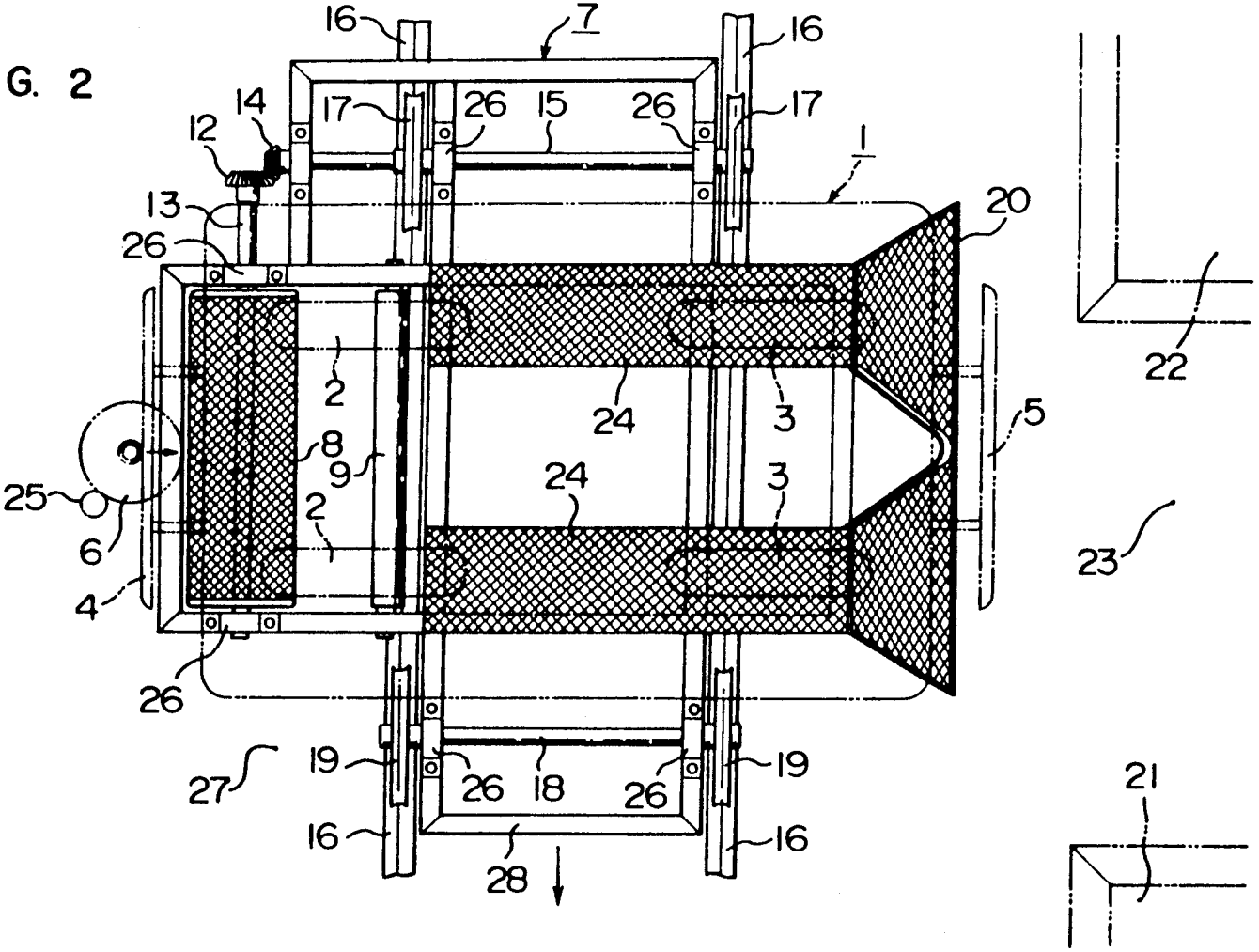
FIG. 2 is plan view of the embodiment.

For this purpose, the piles 25 which are provided in the headland 27 and positioned further from the associated ridges 21 and 22 than the rails 16 should preferably be positioned at a position slightly behind the center of the trough 23 in the direction of advancement of the carriage car 7, as shown in FIG. 2 (the arrow at the bottom indicating the direction of advancement of the carriage car 7).

Figure 3:
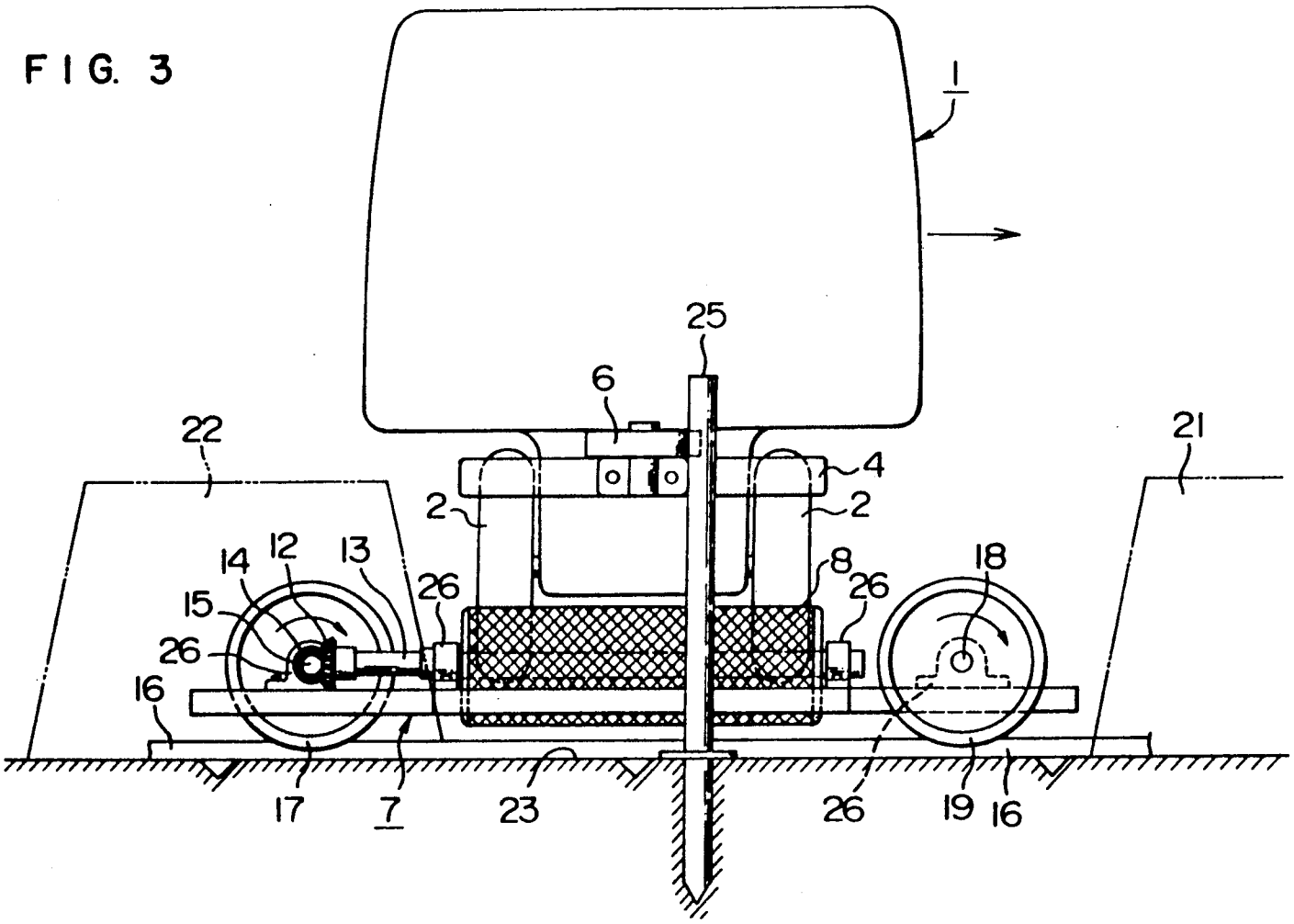
FIG. 3 is a front view of the embodiment.

The construction of the carriage car 7 will be described hereinafter. The carriage car 7 has a frame 28 formed using a plurality of L-shaped steel members and having a generally cross-shaped configuration in which each of a plurality of sides extends either vertically, i.e., longitudinally of a trough 23, or transversely, i.e., longitudinally of the rails 16. End portions of the frame 28 which are positioned frontward and rearward in the transverse direction (for convenience, the lower side as viewed in FIG. 2 or the right side as viewed in FIG. 3 will be called "the front side" of the carriage car 7) have two pairs of bearings 26, each pair rotatably supporting a front and rear axle 18 and 15. Front wheels 19 and rear wheels 17 are secured to the axles 18 and 15, respectively, in such a manner that the carriage car 7 is movable to and fro as being guided by the rails 16.

The carriage car 7 also has floor plates 24 which are provided in compliance with the tread of the rubber-tire type wheels 2 and 3 of the self-propelling car 1. The floor plates 24 extend in parallel from the central portion of the carriage car 7 to that end of the carriage car 7 which is positioned rearward in the vertical direction. A slope plate 20 is provided at the rear ends of these floor plates 24 in order to facilitate the mounting and dismounting of the self-propelling car 1 onto and from the carriage car 7. When the mounting or dismounting has been completed, simultaneously with the completion, a suitable interlocking means (not shown) lifts the slope plate 20 to the position indicated by solid lines in FIG. 1.

An end portion of the frame 28 which is positioned frontward in the vertical direction has a pair of bearings 26 supporting a rotatable drive shaft 13. A friction roller 8 is secured to the rotatable drive shaft 13 and is capable of coming into press contact with the lower side of the front surface of the rubber-tire type front wheels 2 when the self-propelling car 1 is completely mounted on the carriage car 7. When the friction roller 8 is in press contact with the rubber-tire type front wheels 2, the roller 8 is rotated and driven by driving force which the wheels 2 generate in the direction of the forward rotation thereof.

The friction roller 8 has a relatively large diameter in order to secure the effect of stopping the self-propelling car 1 and to achieve positive frictional transmission between the rubber-tire type front wheels 2 and the roller 8.

If the slope plate 20, the floor plates 24, and the friction roller 8 are formed using, e.g., an expandable metal (mesh steel plates), this provides favorable effects of enhancing the coefficient of friction and facilitating eliminate of mud, etc.

The rubber-tire type front wheels 2 are supported by an idle roller 9 rotatively provided at a position of the frame 28 which is slightly behind the center of the front wheels 2, so that the front wheels 2 transmit driving force solely to the friction roller 8.

A driving bevel gear 12 and a driven bevel gear 14 which are disposed in mutual meshing engagement with a suitable gear ratio are provided between the drive shaft 13 to which the friction roller 8 is secured and the rear axle 15 of the carriage car 7.

Accordingly, when the self-propelling car 1 has vertically traveled on a trough 23, and then become mounted on the carriage car 7, the self-propelling car 1 stops its advanced by having its rubber-tire type front wheels 2 pressed against the friction roller 8 of the carriage car 7. The rubber-tire type front wheels 2, however, continue to rotate without any stop, and force is transmitted as driving force from the front wheels 2 via a driving force transmission means formed by the friction roller 8 of the carriage car 7, the drive shaft 13, the driving bevel gear 12, the driven bevel gear 14, the rear axle 15 and the rear wheels 17, whereby the carriage car 7 starts its transverse advancement while the self-propelling car 1 remains mounted on the carriage car 7.

The automatic traveling apparatus of the present invention which has the above-described construction operates in the following manner if used to perform, for instance, sprinkling of chemicals within the greenhouse where vegetables or the like are cultured. The free end of the spraying hose is unwound from the reel of the self-propelling car 1, and is then connected to one end of a supply hose of which the other end communicates with a chemicals supply source provided outside the greenhouse and which is suspended from the ceiling of the greenhouse in such a manner as to be movable in the transverse direction. The carriage car 7 is caused to move on the rails 16 while the self-propelling car 1 is mounted on the carriage car 7 until the self-propelling car 1 is positioned in the headland at one longitudinal end of the innermost trough 23 (i.e., the uppermost trough, as viewed in FIG. 2).

Subsequently, when the switching rod 4 at the front end of the self-propelling car 1 is depressed, the rubber-tire type rear wheels 3 are driven so that the self-propelling car 1 starts rearward movement. The slope plate 20 automatically descends to guide the dismounting of the self-propelling car 1 from the carriage car 7. Thereafter, the self-propelling car 1 continues to travel rearwardly along the length of the trough 23 while the spraying hose is continuously unwound and chemicals are sprinkled.

When the switching rod 5 at the rear end of the self-propelling car 1 abuts against the pile 25 provided in the area at the other end of the trough 23, and is thus depressed, this causes the self-propelling car 1 to stop and, subsequently, the rubber-tire type front wheels 2 of the car 1 to be driven. The self-propelling car 1 starts to move forward and continues the forward movement while the spraying hose is continuously wound onto the hose reel. When the self-propelling car 1 reaches the headland 27, it automatically mounts on the carriage car 7. The slope plate 20 is lifted, and the apparatus assumes a condition where it is ready for transverse movement along the rails 16.

In this condition, each of the piles 25, which is provided in the headland 27 and at that side of the rails 16 remote from the ridges, is positioned slightly behind the center of each of the troughs 23. Therefore, at the starting of the transverse movement, the switching rod 4 at the front end of the self-propelling car 1 is not depressed and, accordingly, the rotation of the rubber-tire type front wheels 2 of the self-propelling car 1 still continues. As a result, this rotation of the front wheels 2 causes the rotation of the friction roller 8 which is in frictional engagement with the front wheels 2. Thus, as stated before, driving force is transmitted through the driving force transmitting means (8, 13, 12, 14, 15 and 17) whereby the carriage car 7 starts to advance transversely on the rails 16 while the self-propelling car 1 is mounted on the carriage car 7.

The carriage car continues to advance until it reaches a location close to the center of an adjacent trough 23, as shown in FIG. 2. At this time, the smoothing roller 6 of the switching rod 4 at the front end of the self-propelling car 1 abuts against the pile 25 provided in the outer end area of the headland 27 and on that side of the rails 16 remote from the ridges 21 and 22. As the outer periphery of the smoothing roller 6 passes the pile 25 as it rubs thereon, the switching rod 4 is depressed. By virtue of this action, the driving of the rubber-tire type front wheels 2 is disconnected. Also provided at this time is the braking effect of certain members in the drive system for the front wheels 2. Thus, the carriage car 7 stops immediately. When the rear wheels 3 of the self-propelling car 1 are driven, the car 1 starts rearward movement. The slope plate 20 automatically descends so that the carriage car 7 is held in the center of the trough 23 while self-propelling car 1 is allowed to dismount from the carriage car 7. The car 1 again starts reciprocating travel on the trough 23. Thereafter, the same actions as those described above are performed in which the self-propelling car 1 automatically travels on every trough.

If the mounting and dismounting action of the self-propelling car 1 onto and from the carriage car 7 is so utilized as to allow the spraying nozzle device to be opened and closed automatically, this is favorable because it is possible to prevent any unnecessary sprinkling of chemicals during travel on the headland 27.

What is claimed is:

1. In an automatic traveling apparatus comprising a self-propelling car having a self-propelling drive means, a carriage car allowing said self-propelling car to be mounted thereon in such a manner that said self-propelling car is dismountable therefrom and a driving-force transmission means capable of engaging with said self-propelling drive means of said self-propelling car when self-propelling car in mounted on said carriage car, said transmission means in its engagement with said self-propelling drive means driving said carriage into traveling, wherein said self-propelling car has wheels having an axis of rotation, said driving-force transmission means including a friction roller rotated by driving front wheels of said self-propelling car, a gear device rotated by said friction roller and capable of converting the forward rotation of said driving wheels into rotation in the direction in which said carriage car travels, said friction roller having the effect of stopping the self-propelling car at a predetermined position on said carriage car and wherein the axis of rotation of said front driving wheel is always approximately parallel to the direction of motion of said carriage car.

* * * * *